US007053836B2

(12) United States Patent
Huang

(10) Patent No.: US 7,053,836 B2
(45) Date of Patent: May 30, 2006

(54) CIRCUIT BOARD ANTENNA FOR LAN COMMUNICATION

(75) Inventor: Jackson Huang, Hsinchu (TW)

(73) Assignee: Z-Com, Inc., Hsinchu (TW)

( * ) Notice: Subject to any disclaimer, the term of this patent is extended or adjusted under 35 U.S.C. 154(b) by 0 days.

(21) Appl. No.: 10/962,615

(22) Filed: Oct. 13, 2004

(65) Prior Publication Data

US 2005/0062652 A1 Mar. 24, 2005

Related U.S. Application Data

(63) Continuation-in-part of application No. 10/412,184, filed on Apr. 11, 2003, now abandoned.

(30) Foreign Application Priority Data

Aug. 6, 2002 (TW) ..... 91212115 A

(51) Int. Cl.
*H01Q 1/38* (2006.01)

(52) U.S. Cl. ..... 343/700 MS; 343/702

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 4,291,312 | A | 9/1981 | Kaloi | 343/700 MS |
| 4,590,614 | A * | 5/1986 | Erat | 455/270 |
| 6,362,784 | B1 * | 3/2002 | Kane et al. | 343/700 MS |
| 6,466,176 | B1 * | 10/2002 | Maoz et al. | 343/767 |
| 6,535,172 | B1 | 3/2003 | Hirabayashi | 343/725 |
| 6,639,560 | B1 * | 10/2003 | Kadambi et al. | 343/700 MS |
| 6,727,854 | B1 | 4/2004 | Fang et al. | 343/700 MS |

* cited by examiner

*Primary Examiner*—Tho Phan
(74) *Attorney, Agent, or Firm*—Rabin & Berdo, P.C.

(57) ABSTRACT

A antenna for improving the data transmission efficiency of the wireless network by using the micro strip and Gama matching theories includes: a dielectric material, two radiating portions locating on the dielectric material, a ground surface locating on the dielectric material with a plurality of holes, and two reactance portions for modulating the antenna impedance. Moreover, two reactance portions are integrated as a Gama matching. Hence, the radiating portions connecting with the reactance portions combine with the ground surface as a micro strip on the dielectric material for conducting the antenna signal.

13 Claims, 3 Drawing Sheets

CIRCUIT BOARD ANTENNA FOR LAN COMMUNICATION

RELATED APPLICATION

This application is a continuation-in-part of U.S. patent application Ser. No. 10/412,184, filed Apr. 11, 2003 now abandoned, which claimed priority from Taiwanese Application No. 091212115, filed Aug. 6, 2002.

BACKGROUND OF THE INVENTION

1. Field of the Invention

This invention relates to an antenna, and more particularly to the new type circuit board antenna for the wireless local area network (LAN) communication.

2. Description of the Related Art

In recent years, the development of communication technology enables people to communicate with each other regardless of distance and time. Information may be transmitted via electrical apparatuses, such as personal computers, notebooks, personal digital assistants (PDA), etc, in a wireless manner. Nowadays, wireless communication applications are very popular in our daily life, such as the wireless mobile phone, the wireless modem, the wireless network card, etc.

Wireless Local Area Network (Wireless LANs) enables users to immediately connect to Internet for browsing information, sending and receiving various data. It is an extension or alternative data communication system besides wired local area networks.

Wireless LANs transmit and receive data over the air using radio frequency (RF) technology for minimizing the need for wired connections. The data being transmitted is superimposed on the RF carrier wave by frequency modulation. Multiple RF carrier waves can exist in the same space at the same time without interference if the RF carrier waves are transmitted on different frequencies.

In a wireless LAN configuration, a transmitter/receiver device, called an access point, connects to the wired network from a fixed location using standard cabling. Further, users can connect to a wireless LAN for transmitting data through a wireless communication device which is installed to electrical apparatuses combining an adapter. Furthermore, the antenna device which is comfortably used in the wireless communication product is used to transmit/receive data. Therefore, antennas are the key components of the circuitry of wireless communication products.

When the antenna is in resonance at a resonance frequency, there will be an electromagnetic (EM) wave excited corresponding to the resonance frequency. The operating length of the antenna is decided by the wavelength (?) of the resonance frequency. The operating length of the conventional antenna used in the wireless communication products, such as the dipole antenna or the micro-strip patch antenna, is one-half of the wavelengths (?/2) of the resonance frequency. Moreover, the impedance of one dipole antenna under this condition is theoretically about 70 ohms resistive, and the dipole antenna generally has the good matching impedance (about 50 ohm resistive) by a matching network, such as gamma match etc. In the other word, the dipole antenna is tuned by adjusting the length of the shorting bar on the gamma match with the variable capacitor half engaged. The gamma match technology involves a small air variable capacitor approximately the given value and an adjustable shorting bar at the terminal connected to the element. In recent years, the planar inverted-F antenna (PIFA) structure has been developed, whose operating length is decreased to one-fourth of the wavelength (?/4) of the resonance frequency.

FIG. 1A and FIG. 1B show the front and back diagrams of the traditional wireless LAN antenna. There are two radiating portions 20, 22, a dielectric material portion 30, and a ground surface 40 with a plurality of holes 50 at the front of the circuit board 10. And there are two radiating portions 120, 122, and a dielectric material portion 130 with a plurality of holes 50 at the back of the circuit board 110. The radiating portions 20, 22, 120, 122 are strip conducting parts with a plurality of holes 50 on the dielectric material portion 30, 130, respectively. The strip conducting parts 20 and 120 are opposite, and the strip conducting parts 22 and 122 are opposite, too. That is, the conduction of the strip conducting part 120 intercommunicates with the conduction of the strip conducting part 20 by holes 50, and the conduction of the strip conducting part 122 intercommunicates with the conduction of the strip conducting part 22 by holes 50. The dielectric materials portions 30, 130 are for isolating the radiating portions 20, 22, 120 122 from the ground surface 40.

Moreover, in U.S. Pat. No. 6,727,854 B2, a planar inverted-F antenna (PIFA) with a first operating bandwidth within the GSM band and a second operating bandwidth within the DCS band is disclosed. The planar inverted-F antenna includes a ground surface, a shorting device, a radiating device coupled to the ground surface through the shorting device, a dielectric material set between the radiating device and the ground surface for isolating the radiating device from the ground surface, and a feeding device set on the ground surface and coupled to the radiating device for transmitting a microwave signal.

As shown in FIG. 2, the radiating device 220 includes three radiating elements. The first and second radiating element can be a meandered metallic strip 221, 222, individually and the third radiating element can be a near-rectangular metallic patch 223. The metallic strips 221, 222, and the metallic patch 223 can be formed with integrity (in an integrated manner, i.e., in one body). In order to decrease the area of the radiating device 220, the metallic strip 221 is meandered around the left side of the metallic patch 223 and the metallic strip 222 is meandered around the right side of the metallic patch 223.

The structure of the traditional wireless LAN circuit board antenna is very simple, but the signal receiving quality is not very good. Thus, there is a need to design a new antenna with better efficiency for improving the data transmission efficiency of the wireless network.

SUMMARY OF THE INVENTION

Accordingly, the invention is directed to an antenna thereof that substantially obviates one or more of the problems due to limitations and disadvantages of the related art. The conducting parts integrated as the reactance portion on printed circuit board (PCB) is modified to solve the problem of circuit matching, thereby increasing antenna efficiency.

An object of the invention is to provide an antenna to improve the data transmission efficiency of the wireless network by using the micro strip and Gama matching theories.

Another object of the invention is to provide a antenna to solve the problem of circuit matching by modifying conducting parts design on PCB.

To achieve these and other advantages and in accordance with the purpose of the present invention, as embodied and broadly described, an antenna including: a dielectric material, two radiating portions locating on the dielectric material, a ground surface locating on the dielectric material with a plurality of holes, and two reactance portions for modulating the antenna impedance. The radiating portions individually include two strip conducting parts with a plurality of holes on the dielectric material, and one terminal of each strip conducting parts connects with the ground surface. Then, the terminal of each strip conducting parts connecting with the ground surface is formed as short terminal. The reactance portions individually include two strip conducting parts, and one strip conducting part is complementary with the other as a capacitance part, thereby compensating for electromagnetic induction induced by the radiating portions. Moreover, one terminal of one of two strip conducting parts connects to the radiating portion. Then, other terminal of that is complementary with one terminal of the other, and it is a pre-determined distance between two strip conducting parts of the reactance portion. Moreover, since the capacitance of the reactance portions is dependent on the pre-determined distance, the pre-determined distance is in accordance with the antenna impedance.

In other word, the position for the radiating portions connected the strip conducting parts and the pre-determined distance between two strip conducting parts of the reactance portion base on the theory of SMITH CHART. Specifically, to achieve good antenna match and antenna performance, the impedance where the reactance portions are connected to the radiating portions should be the same as the antenna impedance. Therefore, we determine the reflection coefficient along the radiating portions to obtain the load impedance of the antenna system using the Smith Chart. Then, we design the shape of reactance portions to induce the capacitance, thereby compensate the load impedance of the antenna system such that achieve 50 ohm. In other word, the pre-determined shape of reactance portions connects to the position for the radiating portions with about 50 ohm of impedance from short terminal respectively.

Therefore, two reactance portions forms Gama matching in the antenna. Hence, the radiating portions connecting with the reactance portions together with the ground surface form a micro strip on the dielectric material for transmitting the antenna signal.

In another aspect, the back side of an antenna comprises a opposite dielectric material, two opposite radiating portions locating on the dielectric material, and a opposite ground surface locating on the dielectric material with a plurality of holes. The opposite radiating portions are parallel with of the radiating portions, and intercommunicate by a plurality of conducting via holes. The opposite ground surface also intercommunicates with the ground surface by a plurality of conducting via holes.

As above, this antenna can be used in a wireless LAN card.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

The drawings, in which.

DETAILED DESCRIPTION OF THE PREFERRED EMBODIMENTS

Reference will now be made in detail to the preferred embodiments of the present invention, examples of which are illustrated in the accompanying drawings.

Hereinafter, embodiments of the present invention will be described in detail with reference to FIGS. 3A, 3B.

Figure 1A:
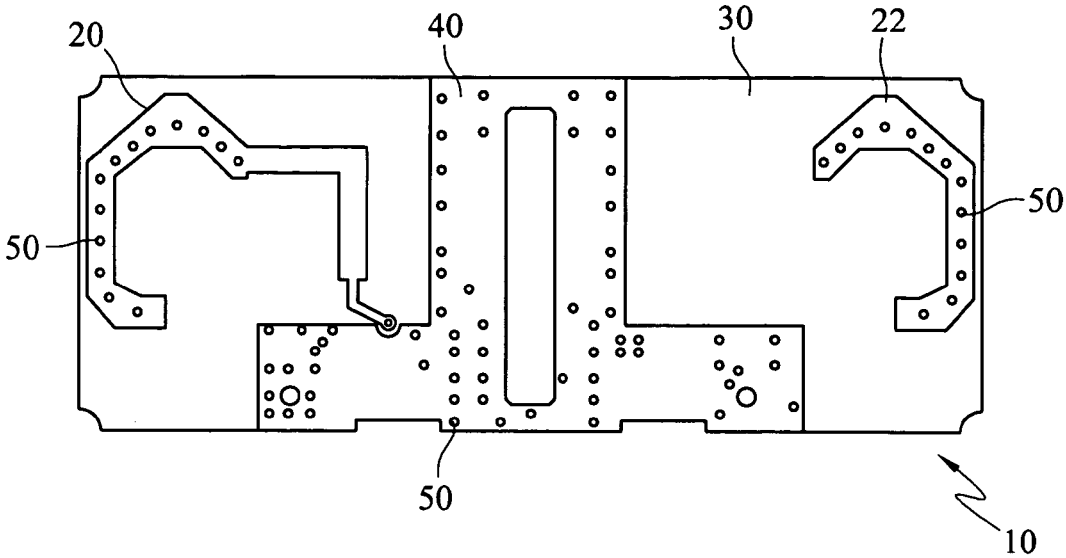
FIG.1A (PRIOR ART)
FIG. 1A illustrates the front view of the antenna according to the related art.
Figure 1B:
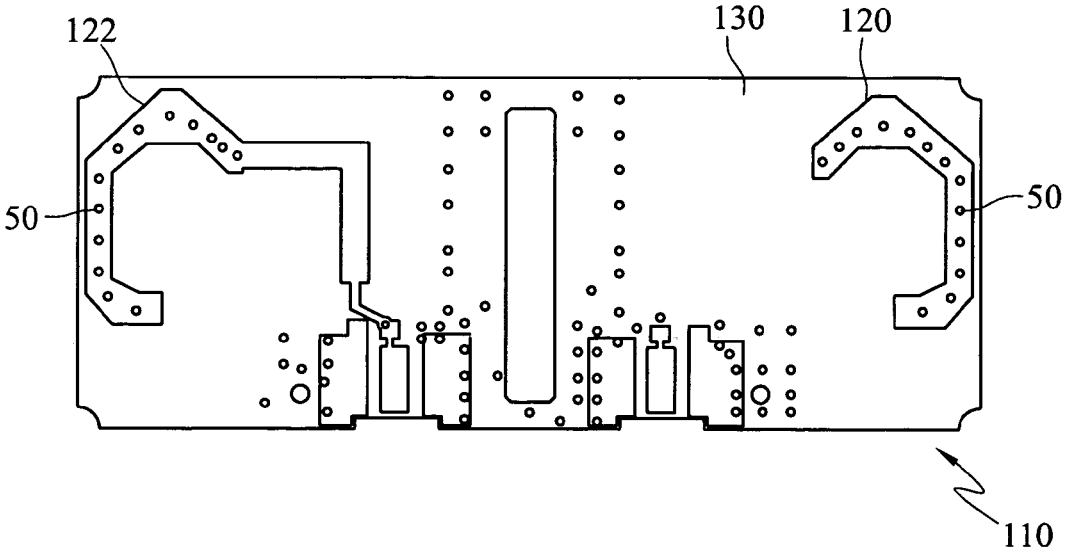
FIG.1B (PRIOR ART)
FIG. 1B illustrates the back view of the antenna according to the related art.
Figure 2:
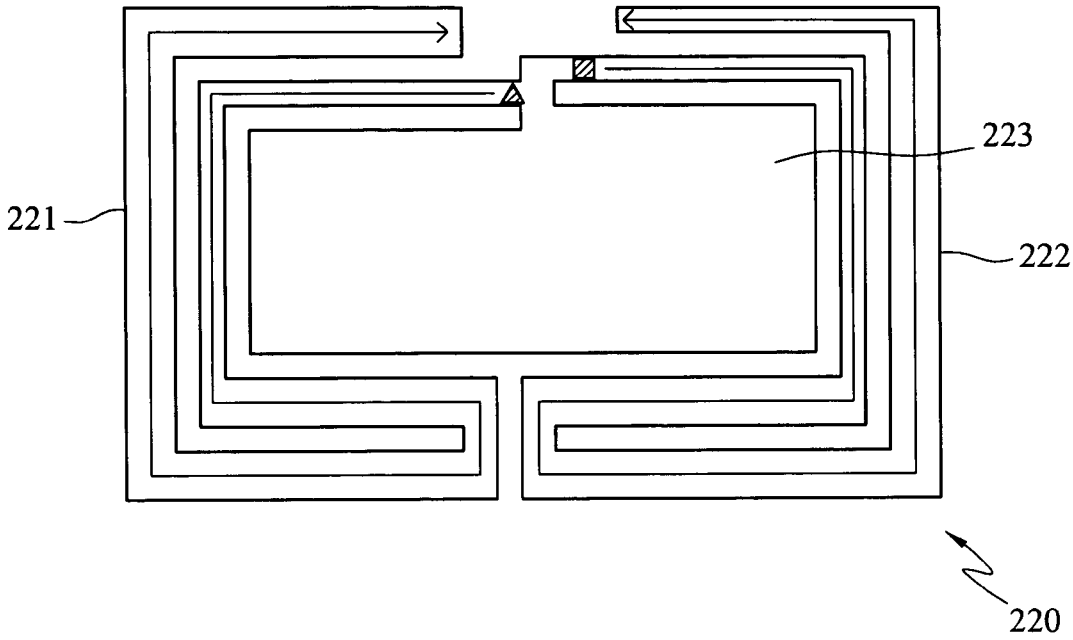
FIG.2 (PRIOR ART)
FIG. 2 illustrates the pattern of the radiating portion of the planar inverted-F antenna according to the related art.
Figure 3A:
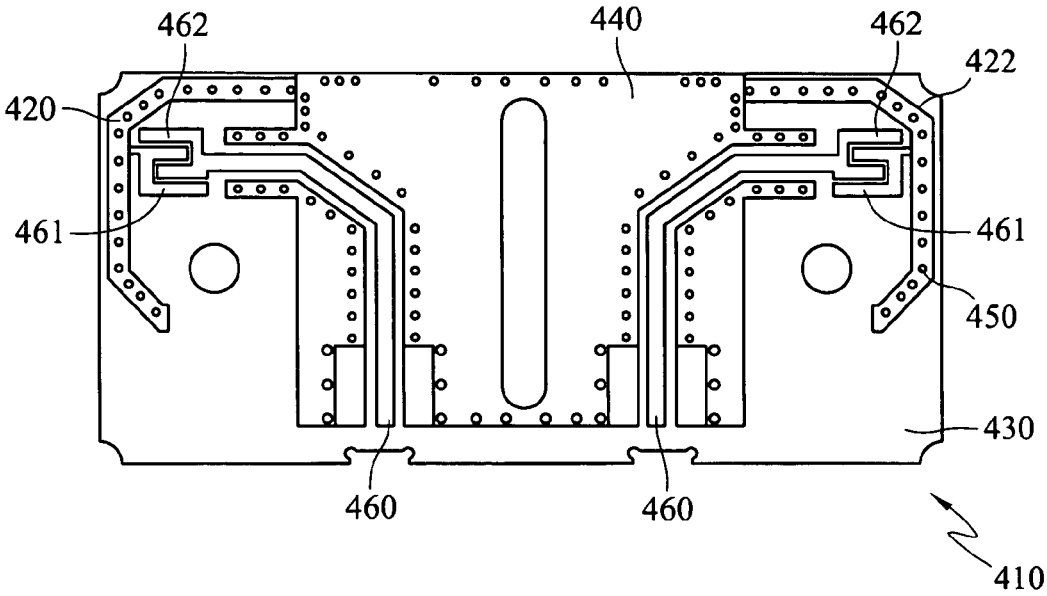
FIG. 3A illustrates the front view of the antenna according to an embodiment of the present invention.
Figure 3B:
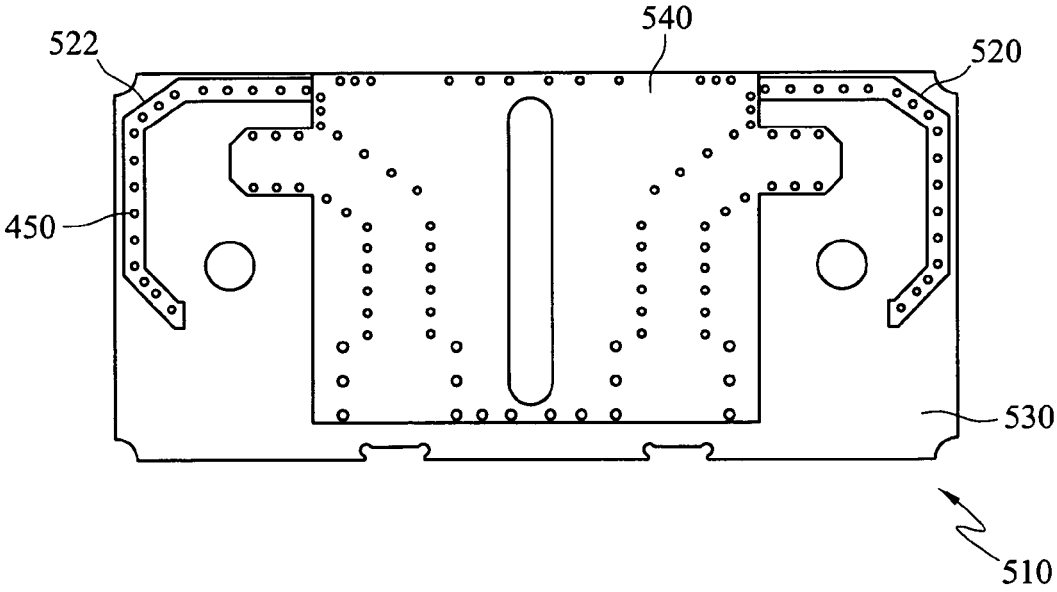
FIG. 3B illustrates the back view of the antenna according to an embodiment of the present invention.

FIGS. 3A, 3B are the front and back views of the antenna according to an embodiment of the present invention. There are two surfaces 410 and 510 on the circuit board, and the circuit board is formed from dielectric material. In the embodiment, on the front surface of the circuit board, the antenna includes: a dielectric material 430, two radiating portions 420, 422 located on the dielectric material 430, a ground surface 440 located on the dielectric material 430 with a plurality of holes, and two reactance portions 460 for modulating the antenna impedance.

On this surface, the radiating portions 420, 422 are two strip conducting part with a plurality of holes 450, and one terminal of each strip conducting part connects with the ground surface 440. Then, the terminal of each strip conducting parts connecting with the ground surface is formed as a short terminal.

The reactance portions 460 individually include two strip conducting parts 461, 462. Moreover, one strip conducting part 461 is complementary with the other part 462 as a capacitance part, thereby compensating for electromagnetic induction induced by the radiating portions 420, 422. Further, one terminal of one of two strip conducting parts 461 connects with the radiating portions 420, 422. Then, the other terminal is complementary with one terminal of the other of two strip conducting parts 462, and it is a pre-determined distance between each other. Moreover, this pre-determined distance leads two strip conducting parts to induce the capacitance, and the capacitance can compensate for electromagnetic induction induced by the radiating portions, thereby modulating the antenna impedance. Therefore, the pre-determined distance is determined in accordance with the antenna impedance. In other word, the pre-determined shape of reactance portions 460 connect to the position for the radiating portions 420, 422 with about 50 ohm of impedance from a short terminal, respectively. Then, two reactance portions are integrated as a Gama matching. Hence, the radiating portions connecting with the reactance portions combine with the ground surface as a micro strip on the dielectric material for transmitting the antenna signal.

In the embodiment, the strip conducting part 461 of the reactance portions connect to the position for a half length of the radiating portions 420, 422, respectively. Further, one terminal of the strip conducting parts 461, 462 are in the form of a U shape, and complementary with each other. Furthermore, there is a pre-determined distance between the U-type terminal of the strip conducting parts 461, 462, and this pre-determined distance is about 0.15 cm.

In another aspect, if two opposite terminals of the strip conducting parts only are a pre-determined distance apart, they are the geometric type besides U-type.

On the back surface of the circuit board, the antenna includes: a opposite dielectric material 530, two opposite radiating portions 520, 522 located on the dielectric material, and an opposite ground surface 540 located on the dielectric material 530 with a plurality of holes 450.

The opposite radiating portions 520, 522 are two strip conducting parts with a plurality of holes 450, and one terminal of the strip conducting parts connects with the opposite ground surface 540. Further, the opposite radiating portions 520, 522 and the opposite ground surface 540 are parallel with the radiating portions 420, 422 and the ground surface 440 and intercommunicate by a plurality of conducting via holes 420.

Furthermore, the antenna of the present invention can be used in the wireless LAN card. Anyway, the quality of the antenna will be improved by the Gama matching of the present invention.

Although the present invention has been explained by the embodiments shown in the drawings described above it should be understood to the ordinary skilled person in the art that the invention is not limited to the embodiments but rather that various changes or modifications thereof are possible without departing from the spirit of the invention Accordingly the scope of the invention shall be determined only by the appended claims and their equivalents

What is claimed is:

1. An antenna, including:

a dielectric material;

two radiating portions located on the dielectric material;

a ground surface located on the dielectric material; and two reactance portions located on the dielectric material and being individually connected to the radiating portions for impedance match of the two radiating portions, the reactance portions individually including two strip conducting parts, which are complementary with each other, for generating a capacitance effect.

2. The antenna of claim 1, wherein one terminal of one of the strip conducting parts connects to the radiating portion, and another terminal of the one of the strip conducting parts and one terminal of the other of the strip conducting parts maintain each other for a pre-determined distance.

3. The antenna of claim 2, wherein the pre-determined distance is determined in accordance with the antenna impedance.

4. The antenna of claim 3, wherein one terminal of each of the strip conducting parts is in the form of a geometric shape and complementary with each other.

5. The antenna of claim 4, wherein the pre-determined distance is about 0.15 cm.

6. The antenna of claim 5, wherein one terminal of each of the strip conducting parts is in the form of a U shape and complementary with each other.

7. The antenna of claim 1, wherein the radiating portions are two strip conducting parts, and one terminal of the strip conducting parts connects with the ground surface.

8. The antenna of claim 7, wherein the two reactance portions connect to a position for the radiating portions with about 50 ohm of impedance from the terminal connecting with the ground surface respectively.

9. The antenna of claim 8, wherein the position is a position for a half length of the radiating portions.

10. The antenna of claim 1, wherein the radiating pardons connecting with the reactance portions combine with the ground surface as a micro strip on the dielectric material for transmitting the antenna signal.

11. The antenna of claim 1, wherein the antenna Is applied to a wireless LAN card.

12. An antennas of comprising:

a dielectric material:

two radiating portions located on the dielectric material;

a ground surface located on the dielectric material;

two reactance portions located on the dielectric material and being individually connected to the radiating portions for impedance match of the two radiating portions;

an opposite dielectric material;

an opposite ground surface being opposite to the ground surface on the dielectric material; and two opposite radiating portions located opposite to the radiating portions on the dielectric material and being connected to the ground surface.

13. The antenna of claim 12, wherein the radiating portions and the ground surface have a plurality of holes and respectively intercommunicate with the opposite radiating portions and the opposite ground surface by a plurality of conducting via the holes.

* * * * *